United States Patent [19]

Bendl

[11] Patent Number: 4,592,336

[45] Date of Patent: Jun. 3, 1986

[54] CHIMNEY COUPLING FOR A FLUE GAS PIPE

[75] Inventor: Peter Bendl, Wolfratshausen, Fed. Rep. of Germany

[73] Assignee: Feodor Burgmann Dichtungswerke GmbH & Co., Wolfratshausen, Fed. Rep. of Germany

[21] Appl. No.: 791,699

[22] Filed: Oct. 25, 1985

[30] Foreign Application Priority Data

Nov. 5, 1984 [DE] Fed. Rep. of Germany ..... 3440375

[51] Int. Cl.[4] ..... F23J 13/00

[52] U.S. Cl. ..... 126/314

[58] Field of Search ..... 126/314–319, 126/307 R, 307 A, 312, 80; 98/46, 60, 58; 52/219

[56] References Cited

U.S. PATENT DOCUMENTS

| | | | |
|---|---|---|---|
| 731,336 | 6/1903 | Brown | 126/314 |
| 1,211,132 | 1/1917 | Galloway | 126/314 |
| 2,159,539 | 5/1939 | Klein | 126/314 |
| 3,136,309 | 6/1964 | Martz | 126/314 |
| 4,463,748 | 8/1984 | Sinkes | 126/316 |

FOREIGN PATENT DOCUMENTS

| | | | |
|---|---|---|---|
| 571741 | 10/1931 | Fed. Rep. of Germany | 126/315 |
| 1018398 | 1/1966 | United Kingdom | 126/314 |

*Primary Examiner*—James C. Yeung

*Attorney, Agent, or Firm*—Spencer & Frank

[57] ABSTRACT

A coupling assembly for connecting a flue gas pipe with an inlet duct of a chimney includes a tubular compensator having a first end secured to the flue gas pipe and a second end oriented towards the inlet duct and having a radially projecting flange. The chimney part which surrounds the inlet duct has a planar face provided with a groove spacedly surrounding the inlet duct. An endless bead forming part of the flange projects from the frontal face thereof and is received in the groove. There are further provided screw connections anchored in the chimney externally of the compensator flange and pressing members operatively connected to the screw connections and being pressed thereby against the flange to clamp the flange against the planar chimney face. The pressing members extend over and across the bead. A rubber-elastic adhesive layer is situated between the flange and the planar face of the chimney and is glued to the flange, the bead, the planar face and the groove.

13 Claims, 5 Drawing Figures

CHIMNEY COUPLING FOR A FLUE GAS PIPE

BACKGROUND OF THE INVENTION

This invention relates to a chimney coupling provided between a chimney inlet duct and the outlet end of a flue gas pipe. The coupling has a compensator (heat expansion equalizer), one end of which is attached to the flue gas pipe and its other end, oriented towards the chimney, has a radially projecting flange which, by means of clamping devices engaging its reverse face, is pressed into sealing engagement with chimney portions surrounding the inlet opening of the duct.

A known chimney coupling of the above type comprises a frame formed of welded metal bars of L-shaped cross section. The frame has a tubular portion which projects into the lateral inlet opening of the chimney duct and which maintains a radial clearance therewith. The frame further has an essentially planar flange which, with the interposition of a ceramic fiber insert, is pressed, by means of screws, against the chimney portion surrounding the duct inlet. The intermediate space between the tubular part and the chimney inlet is filled with mortised asbestos cords and closed off by a sealing mass. The tubular portion of the frame continues outwardly and terminates in a radially outwardly projecting flange portion on which there is held, by means of a clamping bar, a radially outwardly projecting flange of a compensator, whose other end is secured to the flue gas pipe in the same manner. Because of the strong corrosive effect of the flue gases and the entrained or precipitated condensate, it has been necessary to make the above-noted frame of high-grade steel, involving significant expense. Further, large pressing forces have been needed to ensure that the ceramic fiber material has a certain sealing effect. Such forces, however, have led to an excessive load on the chimney masonry. Due to the different heat expansion of the frame relative to the chimney inlet during shutoff or startup, risks of loosening of the components and thus a deterioration of the seal have appeared.

SUMMARY OF THE INVENTION

It is an object of the invention to provide an improved chimney coupling of the above-outlined type which is of inexpensive construction, which eliminates sealing problems and wherein the forces exerted on the chimney masonry are significantly reduced.

This object and others to become apparent as the specification progresses, are accomplished by the invention, according to which, briefly stated, the coupling assembly for connecting a flue gas pipe with an inlet duct of a chimney includes a tubular compensator having a first end secured to the flue gas pipe and a second end oriented towards the inlet duct and having a radially projecting flange. The chimney part which surrounds the inlet duct has a planar face provided with a groove spacedly surrounding the inlet duct. An endless bead forming part of the flange projects from the frontal face thereof and is received in the groove. There are further provided screw connections anchored in the chimney externally of the compensator flange and pressing members operatively connected to the screw connections and being pressed thereby against the flange to clamp the flange against the planar chimney face. The pressing members extend over and across the bead. A rubber-elastic adhesive layer is situated between the flange and the planar face of the chimney and is glued to the flange, the bead, the planar face and the groove.

By virtue of the invention outlined above, leakages may be securely avoided without the use of significant pressing forces and further, substantial savings are realized because the relatively complex coupling frame at the chimney may be dispensed with and all metal components are situated externally of the path of the flue gas and thus may be made of less expensive material. It is, for example, sufficient to make the clamping components (such as clamping bars or clamping jaws and occasionally pressing pieces) from conventional structural steel and to provide them with a protective rubber-elastic anti-corrosion skin.

DESCRIPTION OF THE PREFERRED EMBODIMENTS

Figure 1:
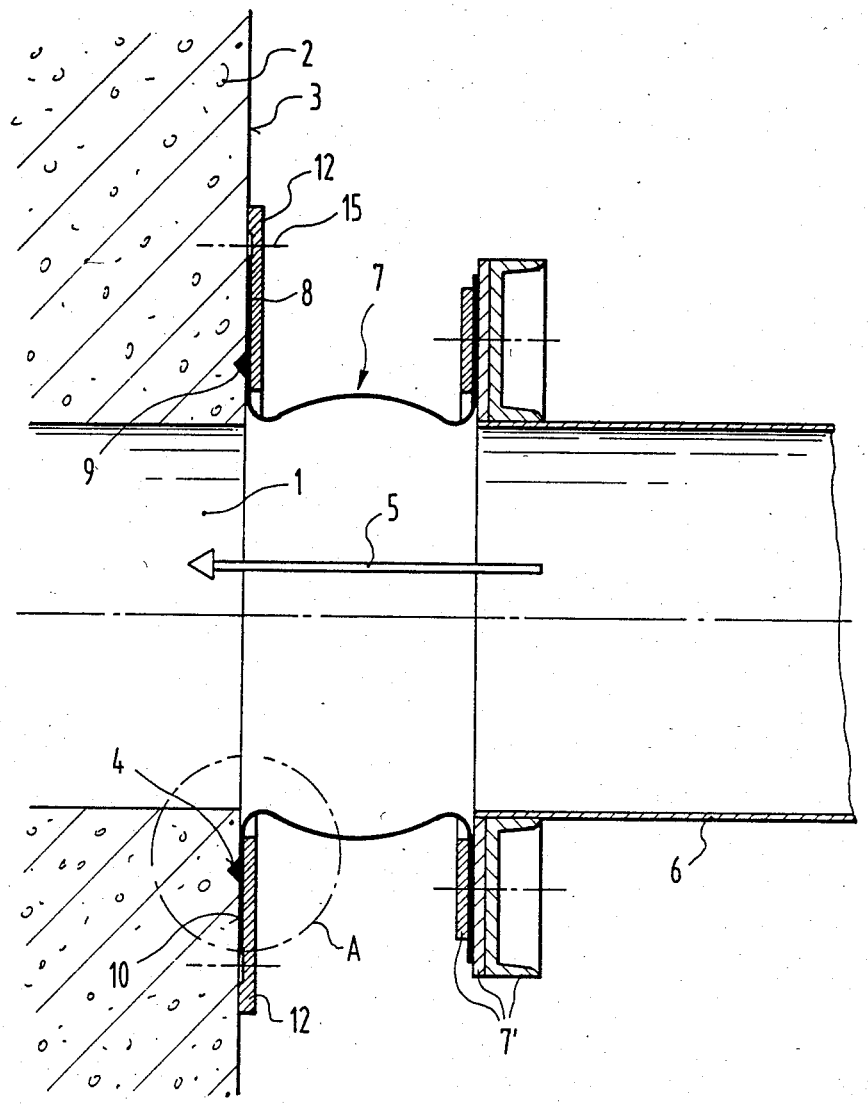
FIG. 1 is an axial sectional view of a preferred embodiment of the invention.

Turning to FIG. 1, there is shown an acid-resistant masonry 2 representing a chimney and defining a lateral inlet 1 of a chimney duct. About the inlet 1 the masonry 2 presents a substantially planar outer face 3. In the face 3 there is provided, by milling or grinding, an endless groove 4 which surrounds the edge of the inlet 1 at a distance of several centimeters. Advantageously, the groove 4 is provided in the masonry stones prior to building the chimney. A flue gas pipe 6 oriented essentially in axial alignment with the chimney inlet 1 terminates at a distance therefrom and guides therein flue gases in the direction of the arrow 5. A compensator 7 made of a rubber-elastic material is, at one end, secured to the terminus of the flue gas pipe 6 by means of a known arrangement 7' formed of a flange surrounding the flue gas pipe 6 as well as clamping strips and screw connections. The other end of the compensator 7 has a radially outwardly projecting flange 8 also made of a rubber-elastic material which is provided with a bead 9 forming an integral part thereof and being at a radial distance of several centimeters from the inner flange edge. The bead 9 projects forwardly from the frontal flange face 10. The cross-sectional configuration of the bead 9 is selected to be complemental to that of the groove 4; the cross-sectional area of the bead 9 may be identical to or somewhat smaller than that of the groove 4.

The frontal surface 10 of the flange 8 is glued to the planar surface 3 of the masonry 2 and the bead 9 is glued into the groove 4 with the interposition of a layer (not shown in FIG. 1 but designated at 11 in FIGS. 2 and 3) which is a two-component elastomer adhesive applied in an unvulcanized state as a plastic rubber mass and is subsequently polymerized whereupon it assumes a rubber-elastic condition. The layer equalizes coarse and finer irregularities of the chimney masonry 2, and the groove 4 and its thickness is dimensioned corresponding to the expected largest irregularities. The adhesive which may be a two-component fluor elastomer adhesive may thus have a thickness of 0.5–10 mm.

Figure 2:
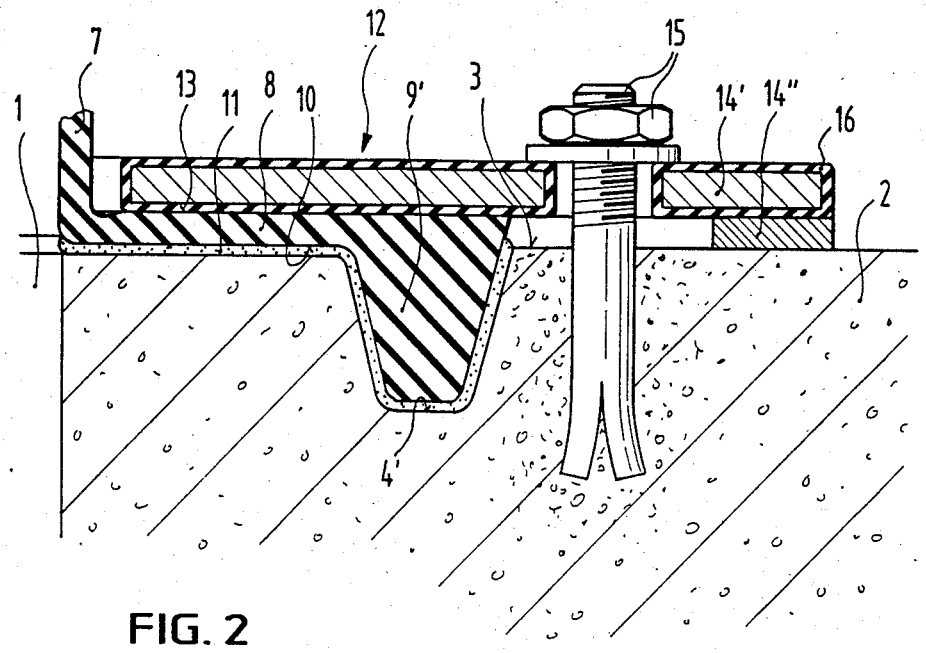
FIG. 2 is an enlarged axial sectional view of a second embodiment of the invention, constituting a modified construction of detail A of FIG. 1.

Also referring to FIG. 2, the flange 8 is pressed against the surface 3 by means of a plurality of clamping parts 12. The latter comprise clamping strips 14' which abut with a small play and which engage the reverse side 13 of the flange 8 over a relatively large surface and extend over the bead 9, including its opposite border zones. The clamping strips 14' project radially outwardly beyond the flange 8 and have, in the zone of their outer end, pressing pieces 14'' which approximately correspond to the thickness of the flange 8 and which are supported on the planar surface 3 of the masonry 2. Between the outer edge of the flange 8 and the pressing pieces 14'' screw connections 15 are provided which comprise upright bolts anchored in the masonry by means of an anchor sleeve or the like. A nut threadedly engaging the bolt generates a pressing force on the clamping strips 14'. The latter and the pressing members 14'' are made of conventional structural steel and are in their entirety coated with a protective layer 16 made of rubber-elastic material.

In the embodiment illustrated in FIG. 1, the bead 9 and thus the groove 4 have a triangular cross-sectional configuration. In the modification illustrated in FIG. 2 the bead 9' and the associated groove 4' have a trapezoidal cross section whereas in the modification illustrated in FIG. 3, the bead 9'' and the associated groove 4'' have a semicircular cross-sectional shape.

Figure 4:
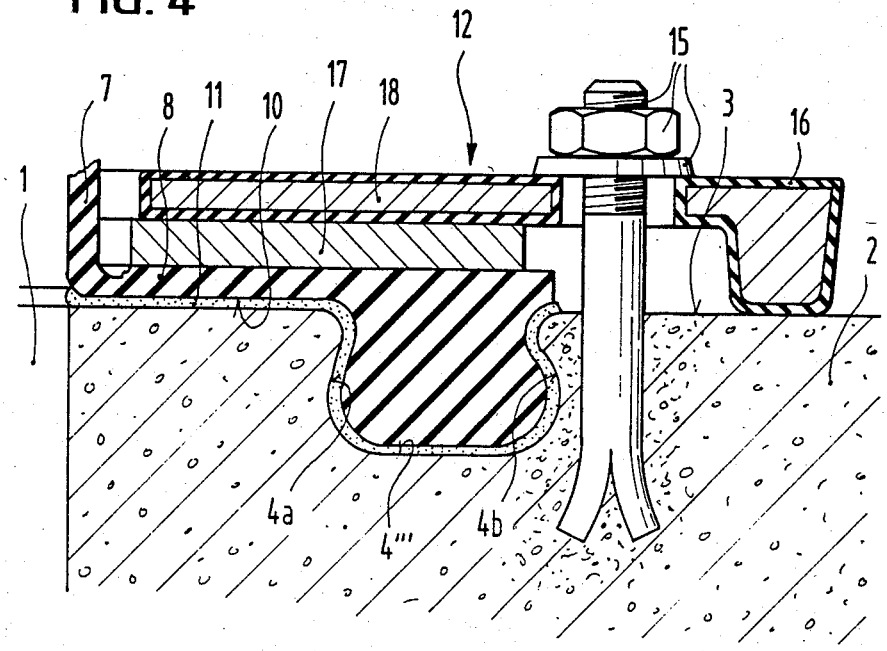
FIG. 4 is an enlarged axial sectional view of a fourth embodiment of the invention, constituting a modified construction of detail A of FIG. 1.
Figure 5:
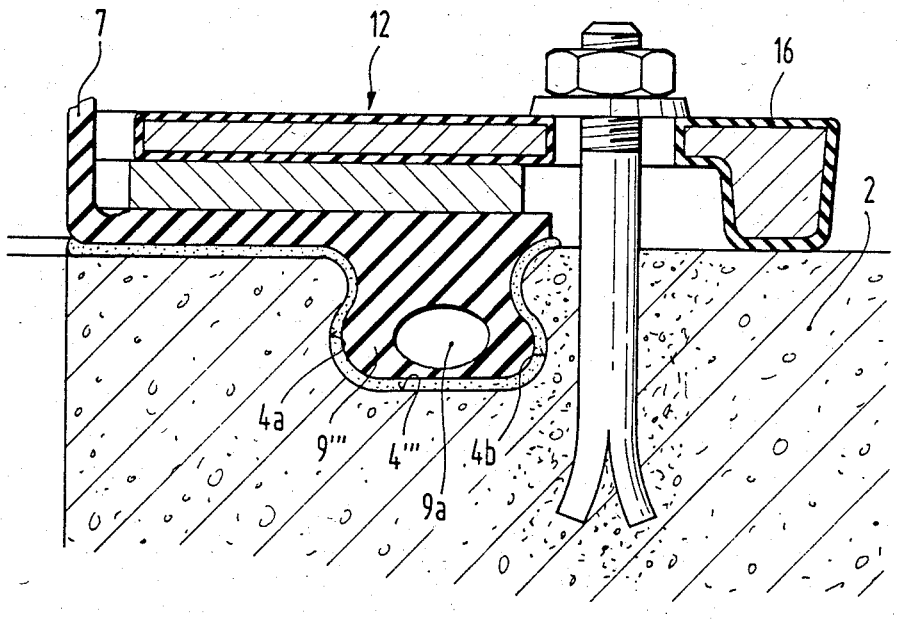
FIG. 5 is an enlarged axial sectional view of a fifth embodiment of the invention, constituting a modified construction of detail A of FIG. 1.

According to the embodiments illustrated in FIGS. 4 and 5, the groove 4''' has at each of its flanks an undercut portion **4*a* and 4*b*, respectively. The associated bead 9''' has, accordingly, lateral projections which are held in a form-locking manner in the undercut portions 4*a* and 4*b*. According to the embodiment shown in FIG. 5, the bead 9''' is provided with a hollow chamber 9*a* extending parallel to the longitudinal axis of the bead. The chamber provides for a softer resiliency of the bead and therefore facilitates its insertion into the groove 4'''**.

In the embodiments according to FIGS. 4 and 5, the clamping parts 12 are formed of flat bars 17 which abut with a slight clearance and each of which is pressed against the bead 9''' by means of a plurality of pressing claws 18 with associated screw connections 15. The flat bars 17 as well as the clamping jaws 18 are made of conventional structural steel and have on their entire surface a protective layer 16 made of a rubber-elastic material.

Dependent upon the particular circumstances of utilization, the flat bars 17 may be omitted from the construction illustrated in FIGS. 4 and 5, and thus the pressing effect may be performed exclusively by the clamping jaws 18.

Figure 3:
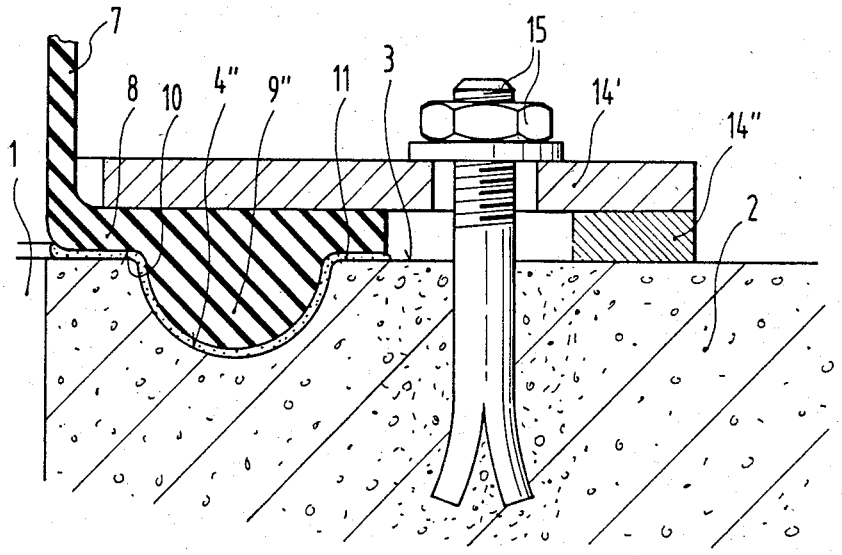
FIG. 3 is an enlarged axial sectional view of a third embodiment of the invention, constituting a modified construction of detail A of FIG. 1.

The described modification of the clamping parts 12 may also find use in the embodiments according to FIGS. 1, 2 or 3 and, conversely, the clamping parts having clamping strips 14' and pressing members 14'' may be utilized in the construction of FIGS. 4 and 5.

It will be understood that the above description of the present invention is susceptible to various modifications, changes and adaptations, and the same are intended to be comprehended within the meaning and range of equivalents of the appended claims.

What is claimed is:

1. In a coupling assembly connecting a flue gas pipe with an inlet duct of a chimney, said coupling assembly including a tubular compensator having a first end secured to said flue gas pipe and a second end oriented towards said inlet duct; said second end having a radially projecting flange having a frontal face oriented towards said inlet duct and a reverse face oriented towards said flue gas pipe; and clamping means for engaging said reverse face of said flange for pressing said frontal face hermetically against said chimney; the improvement comprising (a) a planar face forming part of said chimney and surrounding said inlet duct;

(b) a groove provided in said planar face and spacedly surrounding said inlet duct; said groove having a cross-sectional shape;

(c) an endless bead forming part of said flange and projecting from said frontal face thereof; said bead being received in said groove; said bead having a cross-sectional shape being essentially complemental to the cross-sectional shape of said groove;

(d) screw connections anchored in said chimney externally of said flange of said compensator;

(e) pressing members operatively connected to said screw connections and being pressed thereby against said reverse face of said flange; said pressing members extending over and across said bead; said screw connections and said pressing members forming part of said clamping means; and (f) a rubber-elastic adhesive layer situated between said frontal face of said flange and said planar face and being glued to said frontal face, said bead, said planar face and said groove.

2. A coupling assembly as defined in claim 1, wherein said adhesive layer is a polymerized, two-component elastomer adhesive.

3. A coupling assembly as defined in claim 1, wherein said adhesive layer is a polymerized, two-component fluor elastomer adhesive.

4. A coupling assembly as defined in claim 1, wherein said adhesive layer has a thickness of 0.5 to 10 mm.

5. A coupling assembly as defined in claim 1, wherein the cross-sectional shape of said groove and said bead is triangular.

6. A coupling assembly as defined in claim 1, wherein the cross-sectional shape of said groove and said bead is trapezoidal.

7. A coupling assembly as defined in claim 1, wherein the cross-sectional shape of said groove and said bead is semi-spherical.

8. A coupling assembly as defined in claim 1, wherein said groove has opposite sides and further wherein at least one of said sides has an undercut portion; said bead having a lateral projection extending into said undercut portion.

9. A coupling assembly as defined in claim 1, wherein said bead has a length dimension and an inner hollow chamber extending along said length dimension.

10. A coupling assembly as defined in claim 1, wherein said pressing members comprise pressing strips being in a large-surface contact with said reverse face of said flange.

11. A coupling assembly as defined in claim 1, wherein said pressing members comprise pressing jaws.

12. A coupling assembly as defined in claim 11, wherein said pressing jaws engage directly said reverse face of said flange.

13. A coupling assembly as defined in claim 11, wherein said pressing members further comprise pressing bars and further wherein said pressing jaws engage said reverse face of said flange by means of said pressing bars.

* * * * *